US008281842B2

(12) United States Patent
Lin

(10) Patent No.: US 8,281,842 B2
(45) Date of Patent: Oct. 9, 2012

(54) WINDOW BLIND ASSEMBLY

(76) Inventor: Shih-Ming Lin, Chiayi Hsien (TW)

( * ) Notice: Subject to any disclaimer, the term of this patent is extended or adjusted under 35 U.S.C. 154(b) by 211 days.

(21) Appl. No.: 12/711,334

(22) Filed: Feb. 24, 2010

(65) Prior Publication Data

US 2011/0203742 A1 Aug. 25, 2011

(30) Foreign Application Priority Data

Dec. 3, 2009 (TW) ..... 98141347 A

(51) Int. Cl.
*E06B 3/94* (2006.01)

(52) U.S. Cl. ..... 160/84.04; 160/309

(58) Field of Classification Search ..... 160/84.04, 160/84.01, 177 R, 177 V, 309, 84.02
See application file for complete search history.

(56) References Cited

U.S. PATENT DOCUMENTS 1,789,724 A * 1/1931 Carver ..... 160/84.01
2,110,983 A * 3/1938 Carver ..... 160/84.04
2,260,101 A * 10/1941 De Falco ..... 160/84.04
2,676,654 A * 4/1954 Vallen ..... 160/331
3,371,700 A * 3/1968 Romano ..... 160/84.01
3,487,875 A * 1/1970 Harman et al. ..... 160/84.01
3,817,309 A * 6/1974 Takazawa ..... 160/84.01
4,934,435 A * 6/1990 Regev ..... 160/84.04
5,845,695 A * 12/1998 Cadorette et al. ..... 160/173 V
6,116,319 A * 9/2000 Simon ..... 160/84.01
2006/0157204 A1* 7/2006 Lin ..... 160/84.04
2008/0121353 A1* 5/2008 Detmer et al. ..... 160/266
2010/0294438 A1* 11/2010 Kirby et al. ..... 160/84.04

* cited by examiner

*Primary Examiner* — David Purol
(74) *Attorney, Agent, or Firm* — Tessari Patent Law Group

(57) ABSTRACT

A window blind assembly includes a roller blind unit, a curtain member unit, and a clamping unit. The roller blind unit includes a roller rod that extends horizontally and that is rotatably mounted at or in proximity to an upper edge portion of the window, and a roller blind piece a top edge of which is connected to the roller rod and which is able to be wound around and extended from the roller rod. The curtain member unit includes a curtain member having a sheltering portion and a plurality of partitioning portions. The clamping unit includes a plurality of connecting members associated respectively with the partitioning portions. Each of the connecting members has a confining portion, and two securing portions connected to opposite ends of the confining portion and that connect the confining portion to a respective one of the partitioning portions.

13 Claims, 13 Drawing Sheets

WINDOW BLIND ASSEMBLY

CROSS-REFERENCE TO RELATED APPLICATIONS

This application hereby claims foreign priority benefits under 35U.S.C. 119(a)-(d) or (f), or 365(b) of Taiwanese patent application number 098141347, filed December 3, 2009, entitled "WINDOW BLIND ASSEMBLY".

BACKGROUND OF THE INVENTION

1. Field of the Invention

The present invention relates to a window blind assembly, more particularly to a window blind assembly that is safe, structurally simple, and easily taken apart for cleaning.

2. Description of the Related Art

FIG. 1 shows a conventional roman curtain which includes a curtain cloth 11, a plurality of guide rings 12, and a plurality of cords 13. The guide rings 12 are disposed on one side of the curtain cloth 11. The cords 13 are vertically disposed on said one side of the curtain cloth 11, and extend through the respective guide rings 12. Bottom portions of the cords 13 are connected to a lower portion of the curtain cloth 11 or to lowermost guide rings 12.

When the curtain is in use, the curtain cloth 11 may be extended downwardly or folded in a layer-by-layer manner by manipulation of the cord 13. However, the conventional roman curtain has a complicated structure and is high in cost. Moreover, the curtain cloth 11 of the conventional roman curtain is not easily removed for cleaning or replacement. In addition, strangling injury may occur between the cord 13 and the curtain cloth 11.

SUMMARY OF THE INVENTION

Therefore, the object of the present invention is to provide a window blind assembly which is safe, allows for convenient cleaning and replacement, and is low in cost.

Accordingly, a window blind assembly of the present invention is adapted for being mounted to a window. The window blind assembly comprises a roller blind unit, a curtain member unit, and a clamping unit.

The roller blind unit includes a roller rod that extends horizontally and that is rotatably mounted at or in proximity to an upper edge portion of the window, and a roller blind piece a top edge of which is connected to the roller rod and which is able to be wound around and extended from the roller rod.

The curtain member unit includes a curtain member. The curtain member has a sheltering portion a top edge of which is mounted at or around the upper edge of the window, and a plurality of partitioning portions that extend horizontally, are respectively connected to a rear surface of the sheltering portion, and are vertically spaced apart from each other.

The clamping unit includes a plurality of connecting members associated respectively with the partitioning portions. Each of the connecting members has a confining portion, and two securing portions connected to opposite ends of the confining portion and that connect the confining portion to a respective one of the partitioning portions. The confining portion, the securing portions, and the partitioning portion define a slot thereamong for extension of the roller blind piece therethrough.

When the roller blind unit is manipulated such that the roller blind piece is wound around the roller rod, the sheltering portion is displaced upwardly, thereby folding the sheltering portion.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
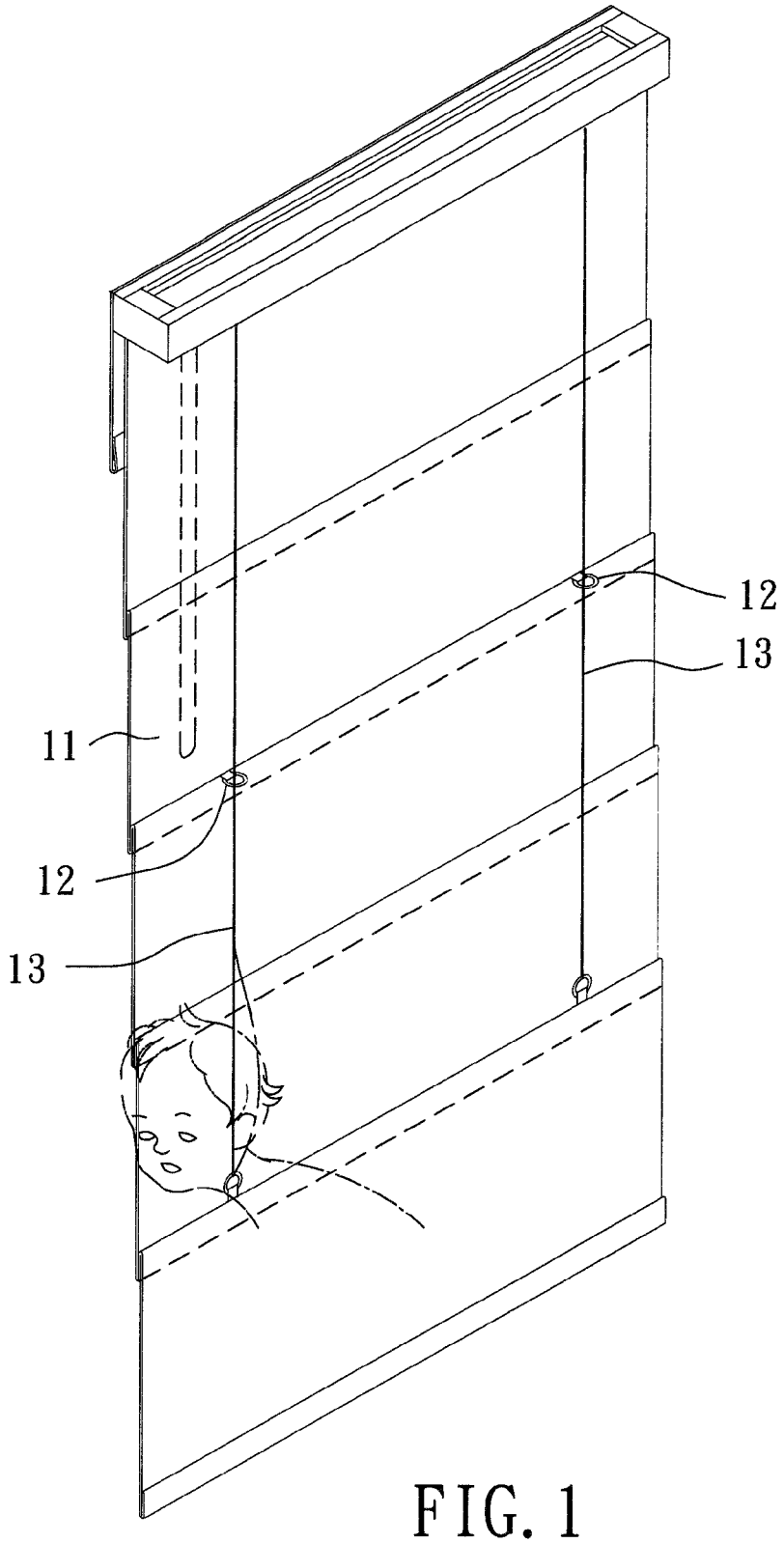
FIG. 1 PRIOR ART
FIG. 1 is a perspective view of a conventional roman curtain.
Figure 2:
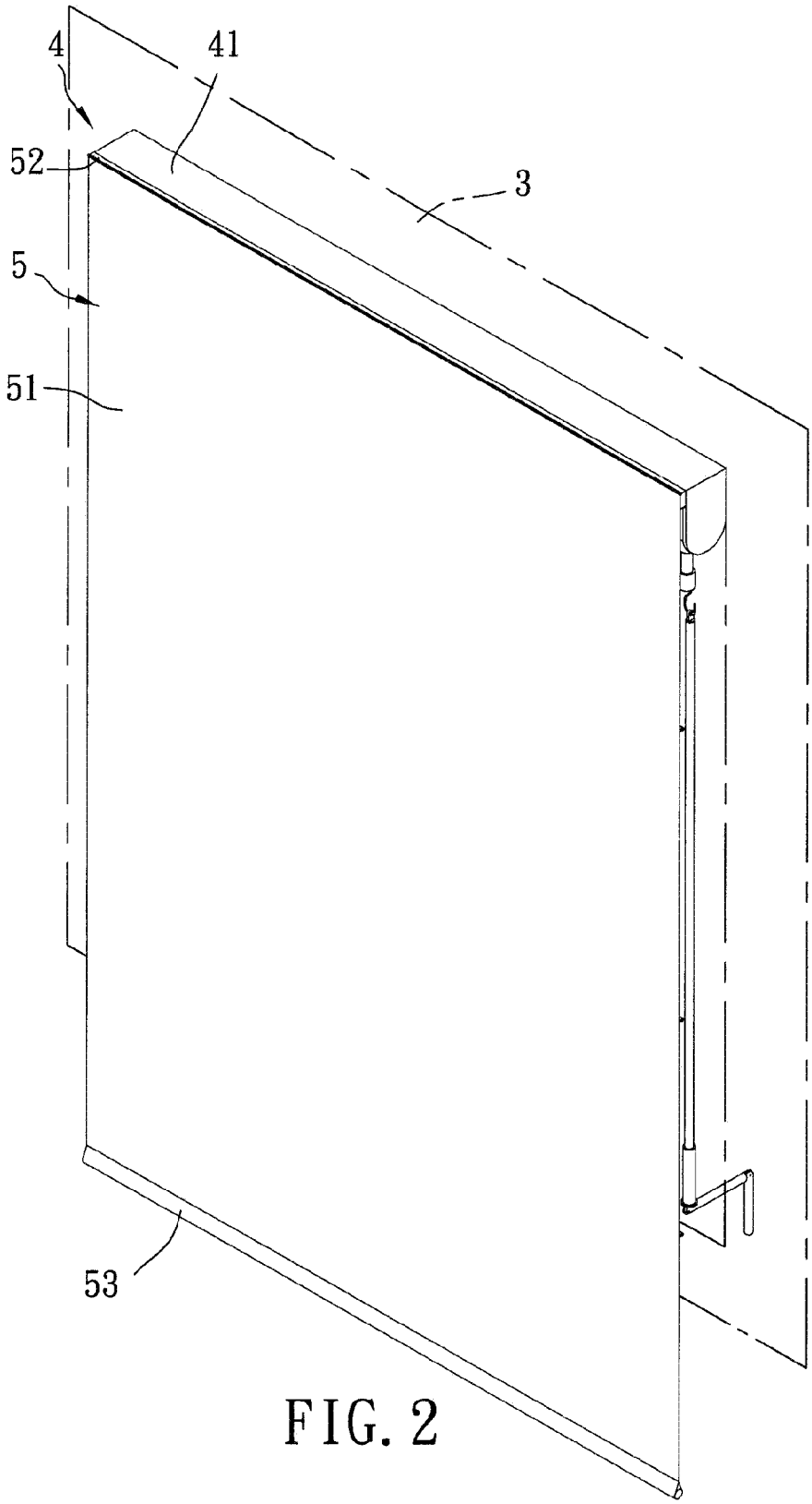
FIG. 2 is a front perspective view of a window blind assembly according to a first preferred embodiment of the present invention.
Figure 3:
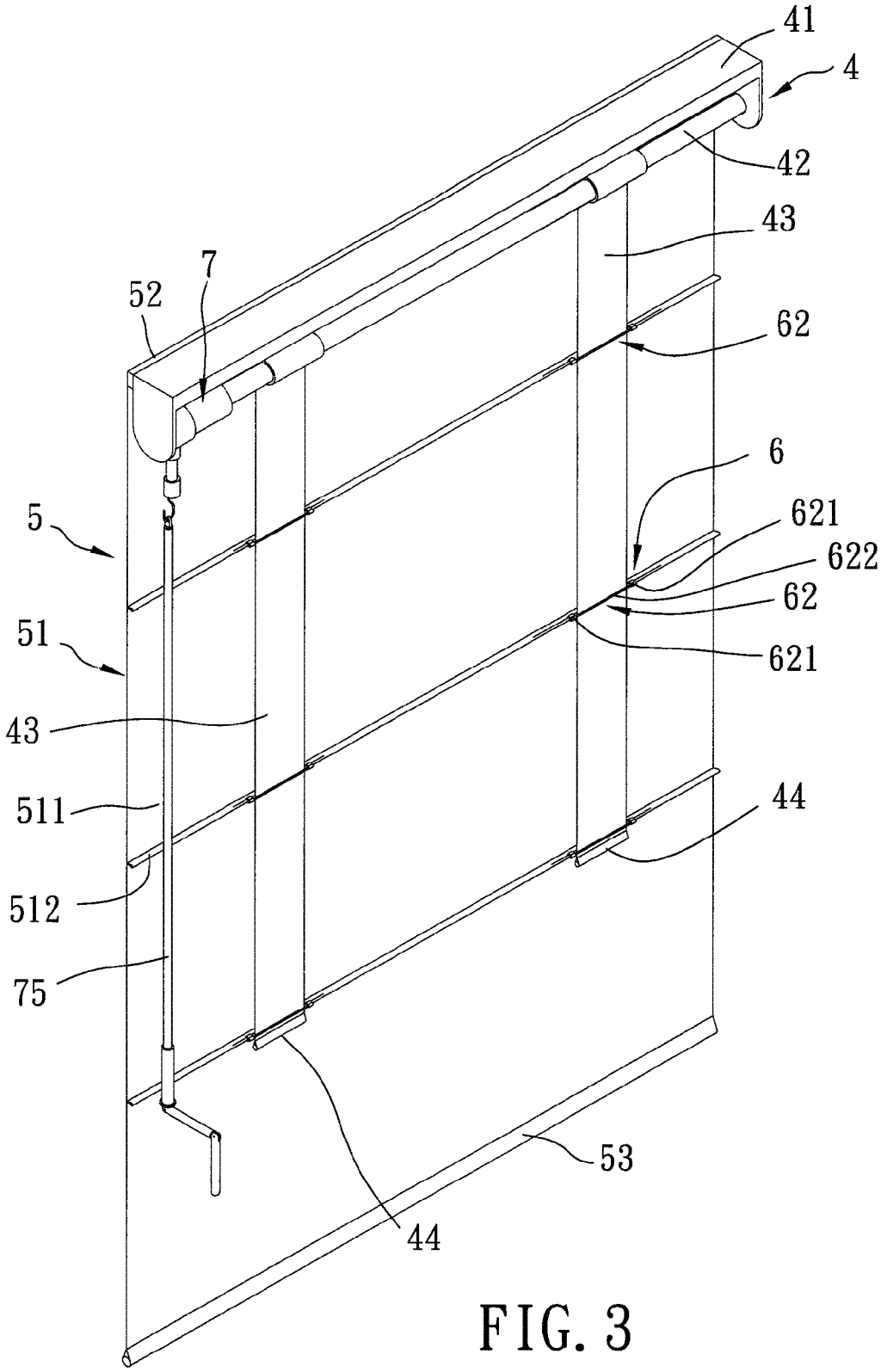
FIG. 3 is a rear perspective view of the window blind assembly of the first preferred embodiment.
Figure 4:
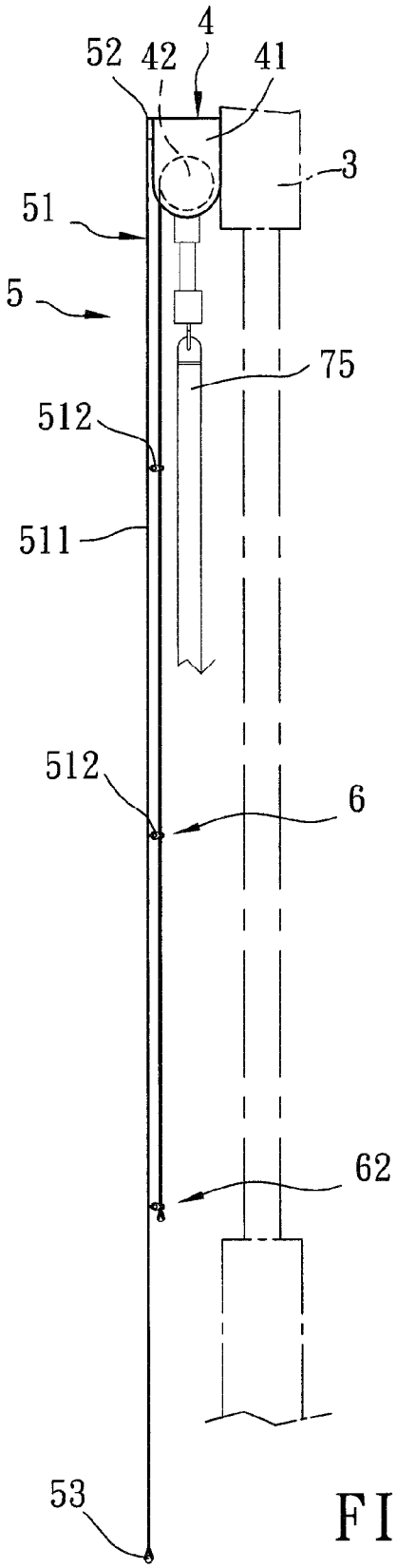
FIG. 4 is a side view of the window blind assembly of the first preferred embodiment.

Referring to FIGS. 2, 3 and 4, a first preferred embodiment of a window blind assembly of the present invention is adapted for being mounted to a window 3. The window blind assembly includes a roller blind unit 4, a curtain member unit 5, and a clamping unit 6.

The roller blind unit 4 includes a roller rod 42, two roller blind pieces 43, a horizontal frame 41, and two weighting rods 44.

The roller rod 42 extends horizontally and is rotatably mounted at or in proximity to an upper edge portion of the window 3. A top edge of each of the roller blind pieces 43 is connected to the roller rod 42, and each of the roller blind pieces 43 is able to be wound around and extended from the roller rod 42 by rotating the roller rod 42 about its axis. The horizontal frame 41 is mounted at least partially surrounding the roller rod 42, and the roller rod 42 is mounted to the horizontal frame 41. Each of the weighting rods 44 extends horizontally, and is connected to a bottom portion of a respective one of the roller blind pieces 43. In this embodiment, the roller blind unit 4 has two roller blind pieces 93 that are horizontally spaced apart. The number of the roller blind pieces 43, which may be greater or less than two, depends on actual requirements.

The curtain member unit 5 includes a curtain member 51, a connector 52, and a flattening rod 53.

The curtain member 51 has a sheltering portion 511 and a plurality of partitioning portions 512. A top edge of the sheltering portion 511 is mounted at or around the upper edge of the window 3, and the sheltering portion 511 is in front of the roller blind pieces 43. The partitioning portions 512 extend horizontally, are respectively connected to a rear surface of the sheltering portion 511, and are vertically spaced apart from each other. Each of the partitioning portions 512 of the curtain member unit 5 is in the form of a cloth tube. The connector 52 interconnects a front edge of the horizontal frame 41 and the top edge of the sheltering portion 511 of the curtain member 51. The flattening rod 53 is connected horizontally to a bottom edge of the curtain member 51 (i.e., of the sheltering portion 511), and pulls down on the curtain member 51 to flatten the same by virtue of its weight.

Figure 5:
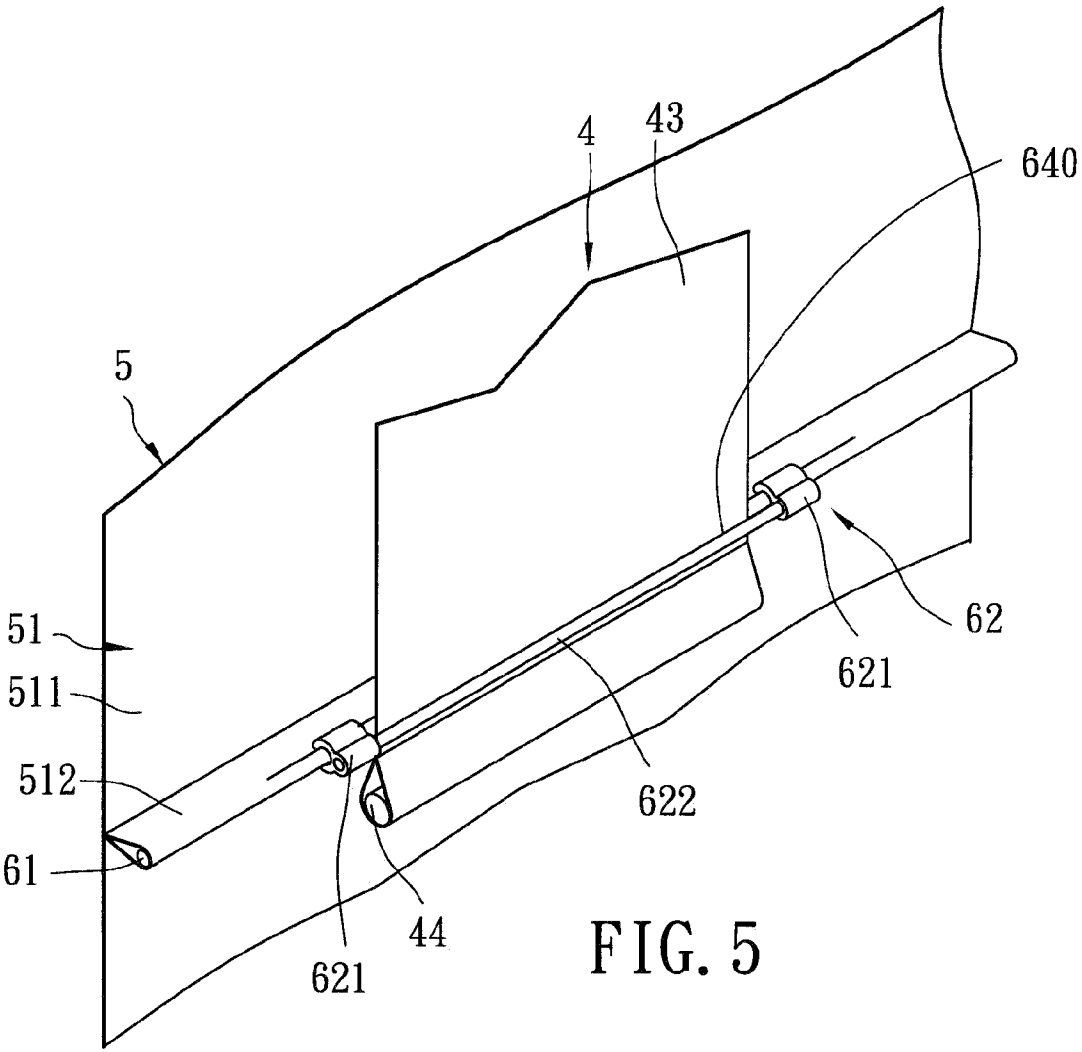
FIG. 5 is a fragmentary perspective view of the window blind assembly of the first preferred embodiment.
Figure 6:
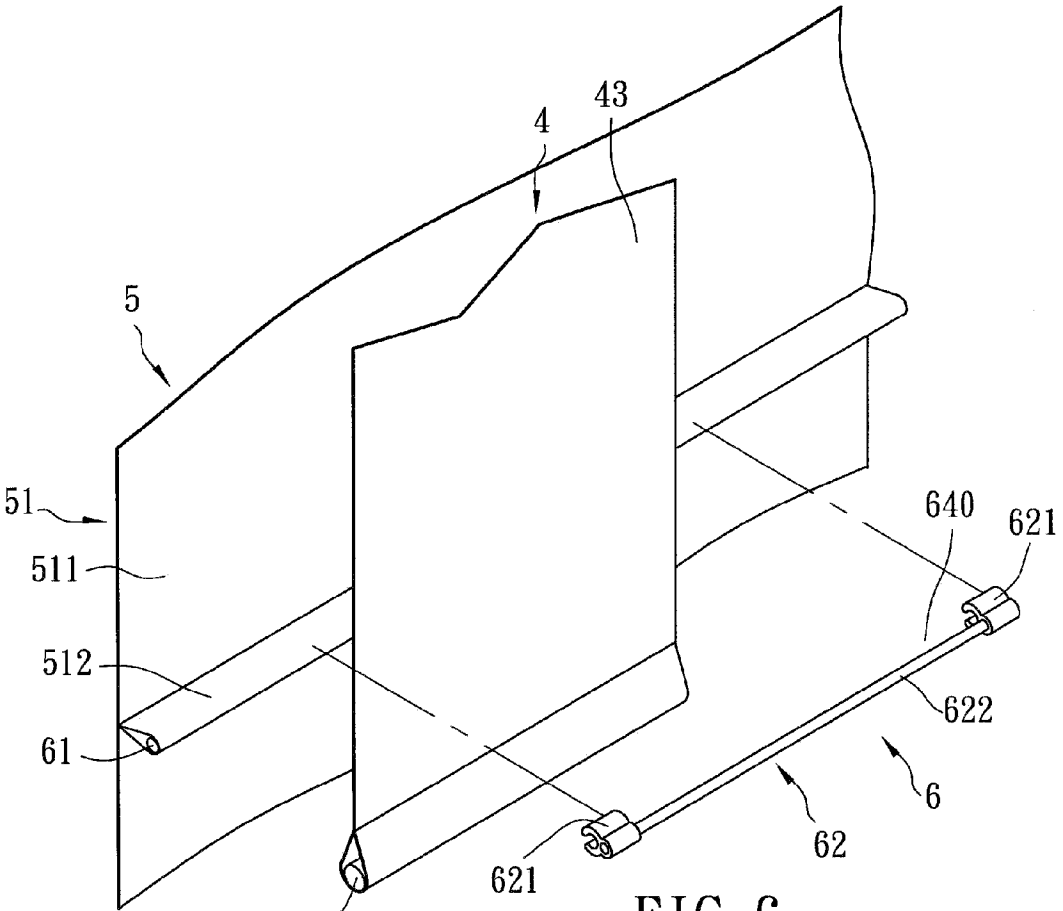
FIG. 6 is a fragmentary exploded perspective view of the window blind assembly of the first preferred embodiment.

Referring to FIGS. 3, 5, and 6, the clamping unit 6 includes two sets of a plurality of connecting members 62. The connecting members 62 of each set of the same is used for a respective one of the roller blind pieces 43, and are associated respectively with the partitioning portions 512 of the curtain member 51.

Each of the connecting members 62 has a confining portion 622 extending horizontally, and two securing portions 621 connected to opposite ends of the confining portion 622 and that connect the confining portion 622 to a respective one of the partitioning portions 512. The confining portion 622, the securing portions 621, and the partitioning portion 512 define a slot 640 thereamong for extension of a respective one of the roller blind pieces 43 therethrough.

Each of the connecting members 62 of each set of the same further has an inserting rod 61. The inserting rod 61 is inserted into a respective one of the partitioning portions 512. The inserting rod 61 is shared between two corresponding connecting members 62 respectively of the two sets of the same.

In this embodiment, each of the confining portions 622 is in the form of a rod. Moreover, each of the securing portions 621 of the connecting member 62 is in the form of a clamp and clamps onto the inserting rod 61 in a respective one of the partitioning portions 512.

When the roller blind unit 4 is manipulated such that the roller blind pieces 43 are wound around the roller rod 42, the sheltering portion 511 is displaced upwardly as a result of the weighting rods 44 abutting against the lowermost connecting members 62 and the lowermost inserting rod 61, such that the sheltering portion 511 is folded.

Figure 7:
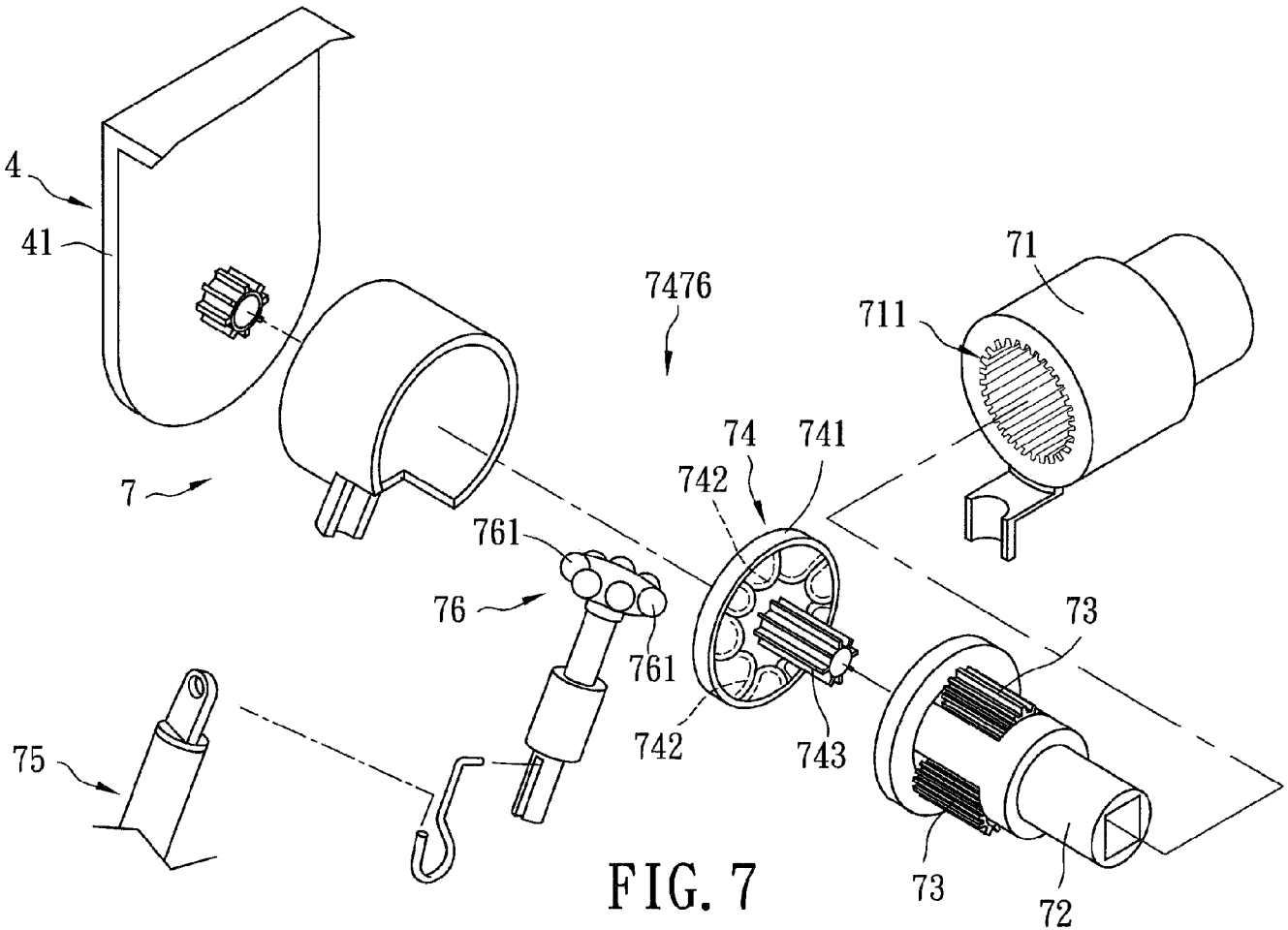
FIG. 7 is an exploded perspective view of a driving unit of the window blind assembly of the first preferred embodiment.

Referring to FIGS. 3, 4, and 7, the roller blind unit 4 further includes a driving unit 7 that is mounted to an end portion of the frame 41 and drives the roller rod 42 of the roller blind unit 4 to rotate about its axis. The driving unit 7 includes a case 71, a driving axial portion 72, three toothed wheels 73, a wheel assembly 7476, and a driving member 75. The driving axial portion 72 is connected to and rotates the roller rod 42. The toothed wheels 73 are formed in the driving axial portion 72. The wheel assembly 7476 rotates the driving axial portion 72. The driving member 75 is operable to drive the wheel assembly 7476.

The drive wheel assembly 7476 includes a first rotating wheel 76 and a second rotating wheel 74. The first rotating wheel 76 is rotated by the driving member 75. The second rotating wheel 74 is engaged with the first rotating wheel 76 so as to be rotated thereby.

The case 71 of the driving unit 7 has internal gear teeth 711 engaged with the toothed wheels 73. The second rotating wheel 74 has a wheel portion 741 and a gear wheel 743. The wheel portion 741 engages the first rotating wheel 76. The gear wheel 743 extends from a center portion of the wheel portion 741 and engages the toothed wheels 73.

A periphery of an end portion of the first rotating wheel 76 is formed with a plurality of spherical portions 761. The wheel portion 741 of the second rotating wheel 74 is formed with a plurality of semi-spherical grooves 742. The spherical portions 761 of the rotating wheel 76 is engaged one at a time with a respective one of the grooves 742 of the wheel 74 when the first rotating wheel 76 is rotated.

In this embodiment, the driving member 75 is in the form of a rod. The driving member 75 is driven and rotated by a user, so as to drive the first rotating wheel 76 to rotate the second rotating wheel 74 about a center axis of the second rotating wheel 74. When the second rotating wheel 74 rotates, the gear wheel 743 of the second rotating wheel 74 drives the toothed wheels 73 such that the driving axial portion 72 can rotate, so as to drive and rotate the roller rod 42 for winding and unwinding the roller blind pieces 43.

Figure 8:
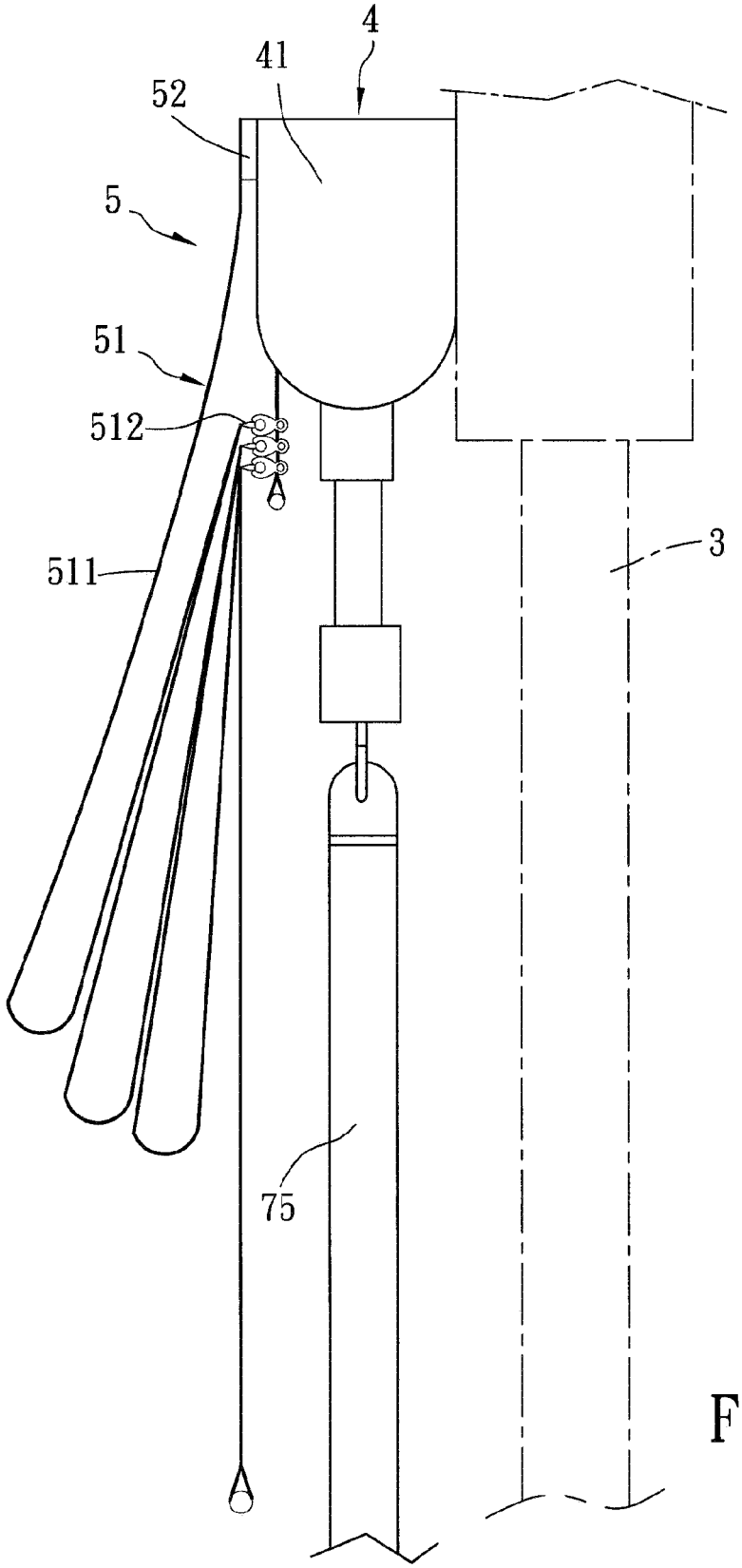
FIG. 8 is a fragmentary side view of the window blind assembly of the first preferred embodiment.

Referring to FIGS. 3, 4, and 5, the roller blind pieces 43 of the roller blind unit 4 and the curtain member 51 of the curtain member unit 5 are respectively unwound and unfolded downwardly when the window 3 is covered. On the other hand, the roller blind pieces 43 of the roller blind unit 4 is wound upwardly by rotating the roller rod 42. When the roller blind pieces 43 are wound around the roller rod 42, the weighting rods 44 move upwardly to first push against the lowermost connecting members 62 and the lowermost inserting rod 61, and to subsequently displace the lowermost connecting members 62 in an upward direction. It is noted that the diameter of each of the weighting rods 44 is greater than a width of the slots 640. This process is repeated with the continued winding of the roller blind pieces 43, such that the roller blind pieces 43 are fully wound around the roller rod 42, and the sheltering portion 511 of the curtain member 51 is eventually folded upwardly as shown in FIG. 8.

Referring to FIGS. 3, 4, and 5, by simply removing the connecting members 62 from the partitioning portions 512 of the curtain member 51, the curtain member 51 can be separated from the roller blind pieces 43. Subsequently, the connector 52 can be disconnected so that the curtain member 51 can be removed for cleaning, or for replacement with another curtain member of a different color and/or style. The roller blind pieces 43 may also be removed for cleaning or replacement. Hence, such removal of the curtain member 51 is very simple. Also, the overall structure of these elements is simple, ultimately resulting in a lower cost for the window blind assembly of the present invention.

Referring to FIGS. 3, 5, and 7, the toothed wheels 73 and the second rotating wheel 74 cooperate with the driving axial portion 72 to slow down a driving speed of the roller rod 42 and to enhance a torsional force of the roller rod 42 for winding the roller blind pieces 43, which can minimize the amount of force required to be exerted by the user. It is noted that the cooperation of the toothed wheels 73, the second rotating wheel 74, and the driving axial portion 72 can position the roller rod 42. That is to say, when roller blind pieces 43 are wound around the roller rod 42, gravity acting on the roller blind pieces 43 cannot result in rotation of the roller rod 42, thereby avoiding inadvertent extension of the curtain member 51.

Figure 9:
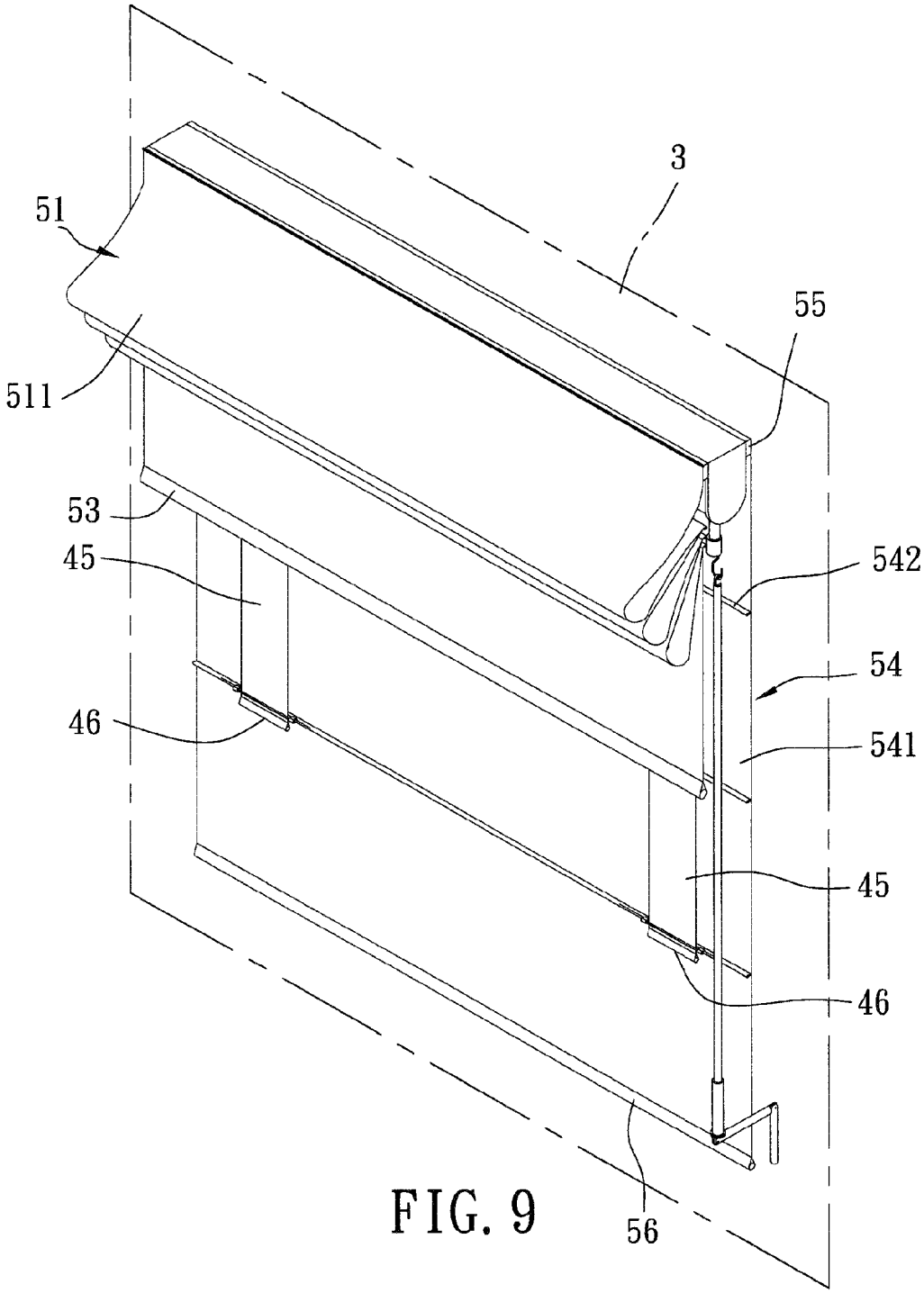
FIG. 9 is a front perspective view of a window blind assembly according to a second preferred embodiment of the present invention.
Figure 10:
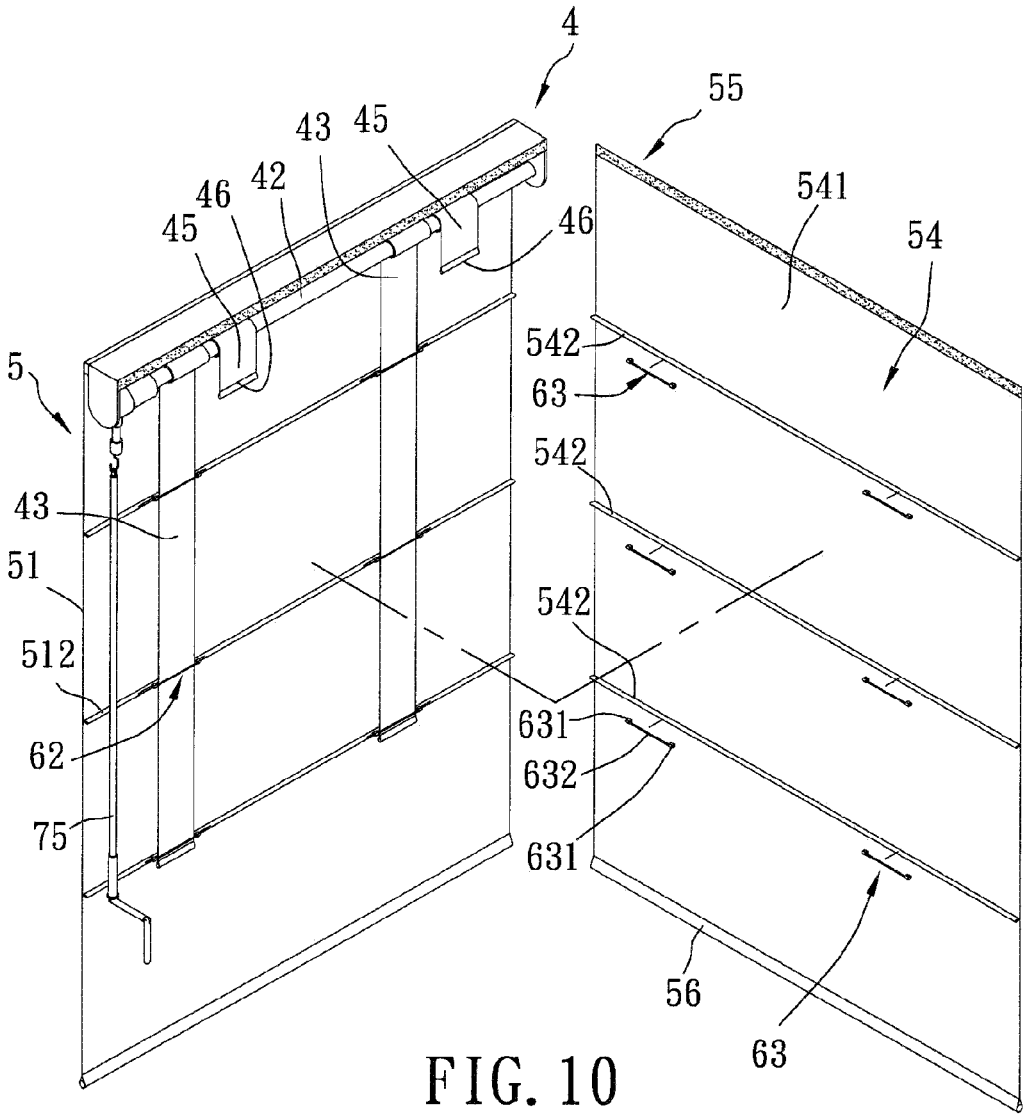
FIG. 10 is an exploded perspective view of the window blind assembly of the second preferred embodiment.
Figure 11:
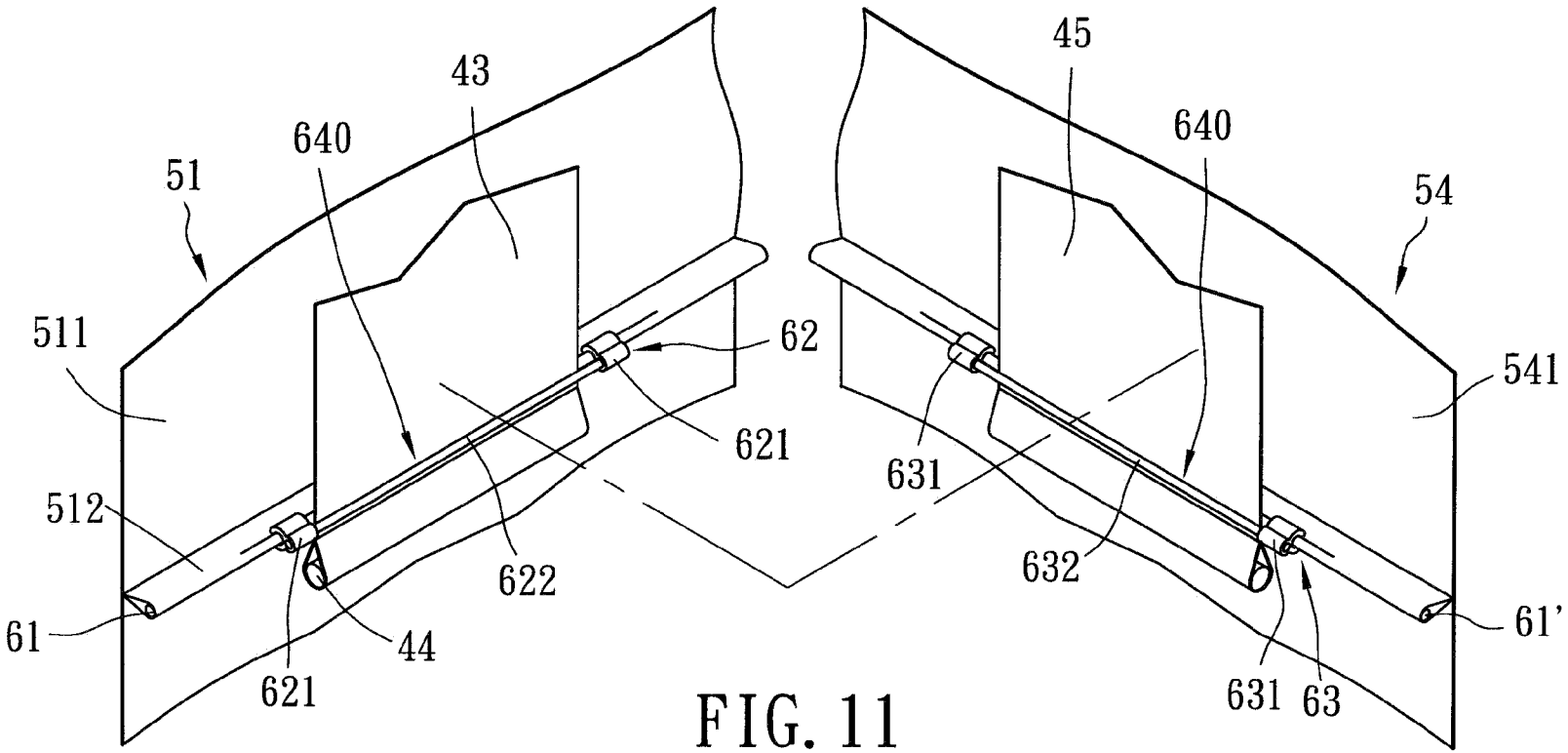
FIG. 11 is a fragmentary perspective view of the window blind assembly of the second preferred embodiment.

FIGS. 9, 10, and 11 illustrate a second preferred embodiment of the window blind assembly according to the present invention. The second preferred embodiment differs from the first preferred embodiment in the following aspects.

The roller blind unit 4 further includes two auxiliary roller blind pieces 45 and two auxiliary weighting rods 46. A top edge of each of the auxiliary roller blind pieces 45 is connected to the roller rod 42, and each of the auxiliary roller blind pieces 45 is able to be wound around and extended from the roller rod 42 in a direction opposite to winding and extending of the roller blind pieces 43. Each of the auxiliary weighting rods 46 extends horizontally, and is connected to a bottom portion of a respective one of the auxiliary roller blind pieces 45.

The curtain member unit 5 further includes an auxiliary curtain member 54, an auxiliary connector 55, and an auxiliary flattening rod 56.

The auxiliary curtain member 54 has an auxiliary sheltering portion 541 and a plurality of auxiliary partitioning portions 542. A top edge of the auxiliary sheltering portion 541 is mounted at or around the upper edge of the window 3, and the auxiliary sheltering portion 541 is positioned rearwardly of the auxiliary roller blind pieces 45. The auxiliary partitioning portions 542 extend horizontally, are respectively connected to a front surface of the auxiliary sheltering portion 541, and are vertically spaced apart from each other. Each of the auxiliary partitioning portions 542 of the curtain member unit 5 is in the form of a tube. The auxiliary connector 55 interconnects a rear edge of the horizontal frame 41 and the top edge of the auxiliary sheltering portion 541 of the auxiliary curtain member 54. The auxiliary flattening rod 56 is connected horizontally to a bottom edge of the auxiliary curtain member 54, and pulls down on the auxiliary curtain member 54 to flatten the same by virtue of its weight.

The clamping unit 6 further includes two sets of a plurality of auxiliary connecting members 63, the auxiliary connecting members 63 of each set thereof being associated with a respective one of the auxiliary blind pieces 45 and respectively with the auxiliary partitioning portions 542 of the auxiliary curtain member 54. Each of the auxiliary connecting members 63 has an auxiliary confining portion 632 extending horizontally, and two auxiliary securing portions 631 connected to opposite ends of the auxiliary confining portion 632 and that connect the auxiliary confining portion 632 to a respective one of the auxiliary partitioning portions 542. The auxiliary confining portion 632, the auxiliary securing portions 631, and the auxiliary partitioning portion 542 define a slot 640 thereamong for extension of a respective one of the auxiliary roller blind pieces 45 therethrough.

Each of the auxiliary connecting members 63 of each set of the same further has an auxiliary inserting rod 61' inserted into a respective one of the auxiliary partitioning portions 542. The auxiliary inserting rod 61' is shared between two corresponding auxiliary connecting members 63 respectively of the two sets of the same.

Each of the auxiliary confining portions 632 is in the form of a rod. Each of the auxiliary securing portions 631 of the auxiliary connecting member 63 is in the form of a clamp, and clamps onto the auxiliary inserting rod 61' in a respective one of the auxiliary partitioning portions 542.

Figure 12:
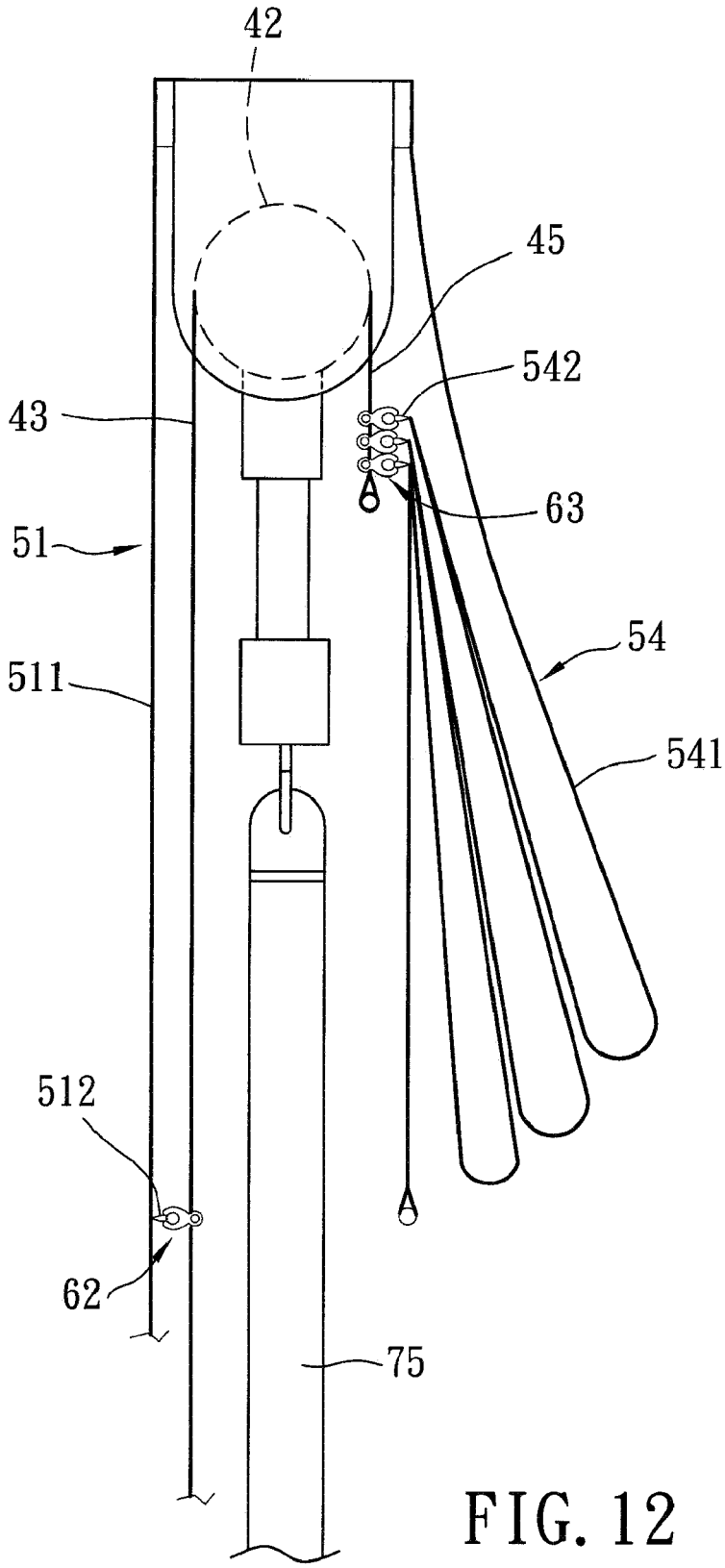
FIG. 12 is a fragmentary side view of the window blind assembly of the second preferred embodiment.

Referring to FIG. 12, when the sheltering portion 511 of the curtain member 51 is in an unfolded state, the auxiliary sheltering portion 541 of the auxiliary curtain member 54 is in a folded state. The sheltering portion 511 can be folded upwardly by rotation of the roller rod 42 which is driven by the driving member 75, and, at the same time, the auxiliary sheltering portion 541 can be unfolded downwardly as shown in FIG. 9. That is to say, a moving direction of the auxiliary sheltering portion 541 is opposite that of the sheltering portion 511 when the roller blind unit 4 is manipulated.

Referring to FIGS. 9, 10, and 12, in some embodiments, the sheltering portion 511 of the curtain member 51 is thicker than the auxiliary sheltering portion 541 of the auxiliary curtain member 54 so that the light transmissivity of the sheltering portion 511 of the curtain member 51 is lower than that of the auxiliary sheltering portion 541 of the auxiliary curtain member 54. Hence, darker or lighter illumination indoors may be controlled by the user.

In addition, by simply removing the connecting members 62 and the auxiliary connecting member 63 respectively from the partitioning portions 512 and the auxiliary partitioning portions 542, the curtain member 51 and the auxiliary curtain member 54 can be separated from the roller blind pieces 43 and the auxiliary roller blind pieces 45. Next, the connectors 52, 55 can be disconnected so that the curtain member 51 and the auxiliary curtain member 54 can be removed for cleaning, or for replacement with other curtain members of a different color and/or style. The roller blind pieces 43 and the auxiliary roller blind pieces 45 may also be removed for cleaning or replacement. Hence, such removal of the curtain members 51 and the auxiliary curtain members 34 is very simple. Also, the overall structure of these elements is simple, ultimately resulting in a lower cost for the window blind assembly of the present invention.

Figure 13:
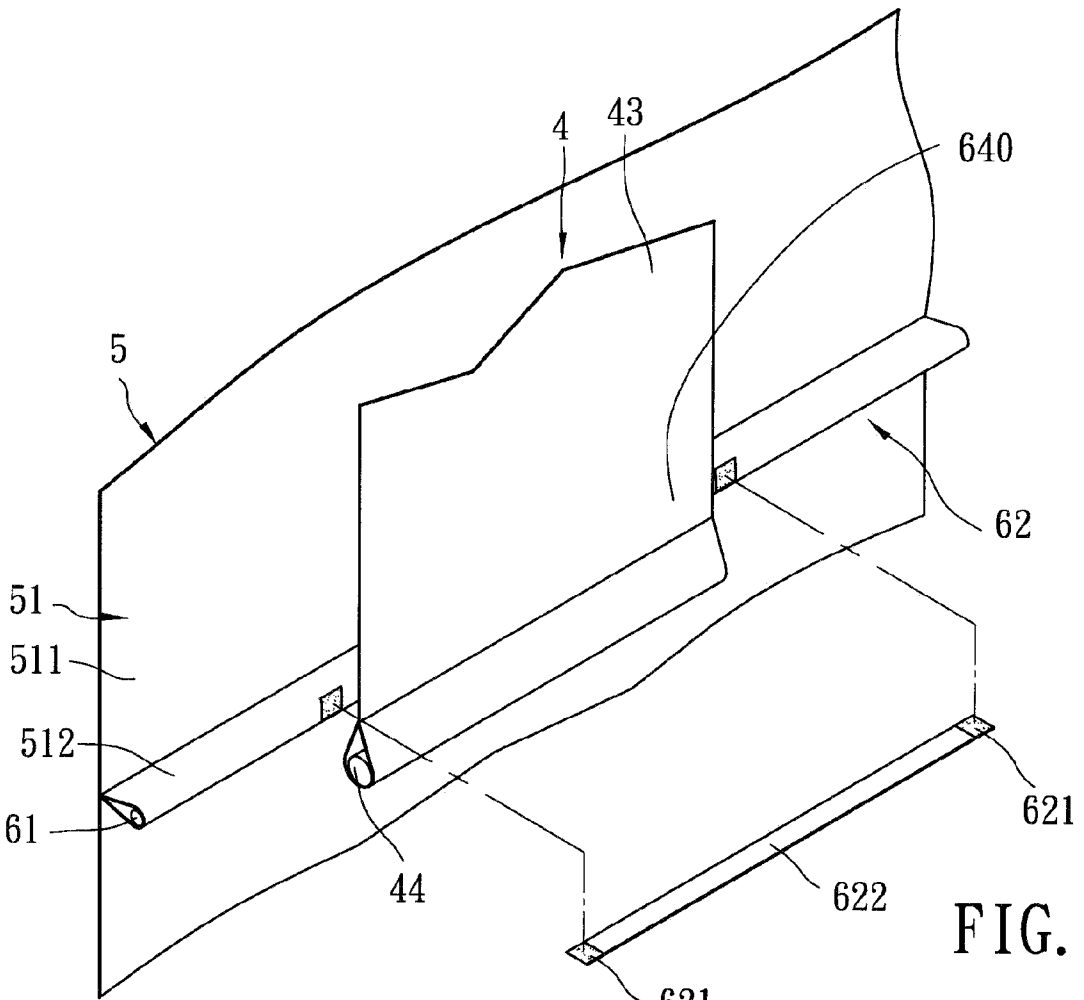
FIG. 13 is a fragmentary exploded perspective view of a window blind assembly according to a third preferred embodiment of the present invention.

FIG. 13 illustrates a third preferred embodiment of the window blind assembly according to the present invention. The third preferred embodiment differs from the first preferred embodiment in the following aspects.

The confining portion 622 of each of the connecting members 62 is in the form a cloth strip, and the securing portions 621 of each of the connecting members 62 includes a pair of one of hook fasteners and loop fasteners connected to opposite ends of the confining portion 622, and a pair of one of hook fasteners and loop fasteners connected to a respective one of the partitioning portions 512.

As an example, loop fasteners realized through a fabric material may be formed on the opposite ends of each of the confining portions 622, and hook fasteners may be disposed on the partitioning portions 512. Consequently, the hook fasteners may attach to the fabric material of the loop fasteners through a hook-and-loop engagement. That is, Velcro® fasteners may be used in this embodiment.

In other embodiments, the connecting members 62 may be realized using a structure of male and female fasteners. Hence, the present invention is not limited to the particular configuration used for the connecting members 62.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind assembly adapted for being mounted to a window, said window blind assembly comprising:

a roller blind unit including a roller rod that extends horizontally and that is rotatably mounted at or in proximity to an upper edge portion of the window, and a roller blind piece a top edge of which is connected to said roller rod and which is able to be wound around and extended from said roller rod;

a curtain member unit including a curtain member, said curtain member having a sheltering portion a top edge of which is mounted at or around the upper edge of the window, and a plurality of partitioning portions that extend horizontally, are respectively connected to a rear surface of said sheltering portion, and are vertically spaced apart from each other; and a clamping unit including a plurality of connecting members associated respectively with said partitioning portions, each of said connecting members having a confining portion, and to securing portions that are connected to opposite ends of said confining portion and that connect said confining portion to respective one of said partitioning portions, said confining portion, said securing portions, and said partitioning portion defining a slot thereamong for extension of said roller blind piece therethrough;

wherein when said roller blind unit is manipulated such that said roller blind piece is wound around said roller rod, said sheltering portion is displaced upwardly, thereby folding said sheltering portion;

wherein each of said connecting members further has an inserting rod inserted into the respective one of said partitioning portions; and wherein each of said securing portions of each of said connecting members has a sleeve part formed with a recess that is engaged with an end of said confining portion of said connecting member, and a clamping part coupled removably to a part of the respective one of said partitioning portions that is wound around said inserting rod and cooperating with said inserting rod to clamp said roller blind piece therebetween.

2. The window blind assembly as claimed in claim 1, wherein said roller blind unit further includes a horizontal frame that is mounted at least partially surrounding said roller rod into which said roller rod is mounted.

3. The window blind assembly as claimed in claim 2, wherein said curtain member unit further includes a connector that interconnects said horizontal frame and said top edge of said sheltering portion.

4. The window blind assembly as claimed in claim 2, wherein said roller blind unit includes a driving unit that is mounted to an end portion of said frame and drives said roller rod to rotate, said driving unit including a case, a driving axial portion that is connected to and rotates said roller rod, a wheel assembly that rotates said driving axial portion, and a driving member that is operable to drive said wheel assembly.

5. The window blind assembly as claimed in claim 4, wherein said drive wheel assembly includes a first rotating wheel which is rotated by said driving member, and a second rotating wheel engaged with said first rotating wheel so as to be rotated thereby, said driving member being in the form of a rod.

6. The window blind assembly as claimed in claim 5, wherein a periphery of an end portion of said first rotating wheel is formed with a plurality of spherical portions, said second rotating wheel being formed with a plurality of semi-spherical grooves, said spherical portions of said rotating wheel being engaged one at a time with a respective one of said grooves of said wheel when said first rotating wheel is rotated.

7. The window blind assembly as claimed in claim 5, wherein said case of said driving unit has internal gear teeth, said driving unit including at least two toothed wheels formed in said driving axial portion and which engage said internal gear teeth, said second rotating wheel having a wheel portion that engages said first rotating wheel, and a gear wheel that extends from a center portion of said wheel portion and engages said tooth wheels.

8. The window blind assembly as claimed in claim 1, wherein:

said roller blind unit further includes an auxiliary roller blind piece a top edge of which is connected to said roller rod and which is able to be wound around and extended from said roller rod in a direction opposite to winding and extending of said roller blind piece;

said curtain member unit further includes an auxiliary curtain member, said auxiliary curtain member having an auxiliary sheltering portion a top edge of which is mounted at or around the upper edge of the window, and a plurality of auxiliary partitioning portions that extend horizontally, are respectively connected to a front surface of said auxiliary sheltering portion, and are vertically spaced apart from each other; and said clamping unit further includes a plurality of auxiliary connecting members associated respectively with said auxiliary partitioning portions, each of said auxiliary connecting members having an auxiliary confining portion, and two auxiliary securing portions connected to opposite ends of said auxiliary confining portion and that connect said auxiliary confining portion to a respective one of said auxiliary partitioning portions, said auxiliary confining portion, said auxiliary securing portions, and said auxiliary partitioning portion defining a slot thereamong for extension of said auxiliary roller blind piece therethrough;

wherein when said roller blind unit is manipulated, a moving direction of said auxiliary sheltering portion is opposite to that of said sheltering portion.

9. The window blind assembly as claimed in claim 8, wherein:

each of said partitioning portions and each of said auxiliary partitioning portions of said curtain member unit is in the form of a tube;

each of said connecting members further has an inserting rod inserted into a respective one of said partitioning portions;

each of said auxiliary connecting members further has an auxiliary inserting rod inserted into a respective one of said auxiliary partitioning portion;

each of said confining portions and set auxiliary confining portions is in the form of a rod;

each of said securing portions of said connecting member and said auxiliary securing portions of said auxiliary connecting member is in the form of the clamp, and clamps onto said inserting rod or said auxiliary inserting rod in a respective one of said partitioning portions or said auxiliary partitioning portions.

10. The window blind assembly as claimed in claim 8, wherein said roller blind unit further includes a weighting rod that extends horizontally and that is connected to a bottom portion of said roller blind piece, and an auxiliary weighting rod that extends horizontally and that is connected to a bottom edge of said auxiliary roller blind piece.

11. The window blind assembly as claimed in claim 1, wherein said confining portion of each of said connecting members is in the form of a cloth strip, and said securing portions of each of said connecting members includes a pair of one of hook fasteners and loop fasteners connected to opposite ends of said confining portion, and a pair of one of hook fasteners and loop fasteners connected to a respective one of said partitioning portions.

12. The window blind assembly as claimed in claim 1, wherein said roller blind unit further includes a weighting rod that extends horizontally and that is connected to a bottom portion of said roller blind piece.

13. The window blind assembly as claimed in claim 1, wherein:

each of said partitioning portions is in the form of a tube;

each of said connecting members further has an inserting rod inserted into a respective one of said partitioning portions;

each of said confining portions is in the form of a rod; and each of said securing portions is in the form of the clamp and clamps onto said inserting rod and a respective one of said partitioning portions.

* * * * *